US007883591B2

(12) United States Patent
Benedictus et al.

(10) Patent No.: US 7,883,591 B2
(45) Date of Patent: Feb. 8, 2011

(54) HIGH-STRENGTH, HIGH TOUGHNESS AL-ZN ALLOY PRODUCT AND METHOD FOR PRODUCING SUCH PRODUCT

(75) Inventors: Rinze Benedictus, Delft (NL); Christian Joachim Keidel, Montabaur (DE); Alfred Ludwig Heinz, Niederahr (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 244 days.

(21) Appl. No.: 11/239,651

(22) Filed: Sep. 30, 2005

(65) Prior Publication Data

US 2006/0174980 A1 Aug. 10, 2006

Related U.S. Application Data

(60) Provisional application No. 60/616,227, filed on Oct. 7, 2004.

(30) Foreign Application Priority Data

Oct. 5, 2004 (EP) ..... 04077721

(51) Int. Cl.
*C22F 1/04* (2006.01)

(52) U.S. Cl. ..... 148/552

(58) Field of Classification Search ..... 148/552
See application file for complete search history.

(56) References Cited

U.S. PATENT DOCUMENTS

| | | | |
|---|---|---|---|
| 2,249,349 | A | 7/1941 | Deutsch |
| 3,287,185 | A | 11/1966 | Vachet et al. |
| 3,305,410 | A | 2/1967 | Sublett et al. |
| 3,418,090 | A | 12/1968 | Fritzlen |
| 3,674,448 | A | 7/1972 | Brown et al. |
| 3,791,876 | A | 2/1974 | Kroger |
| 3,791,880 | A | 2/1974 | Hunsicker et al. |
| 3,794,531 | A | 2/1974 | Markworth et al. |
| 3,826,688 | A | 7/1974 | Levy, S E. |
| 3,857,973 | A | 12/1974 | McKee et al. |
| 3,881,966 | A | 5/1975 | Staley et al. |
| 3,984,259 | A | 10/1976 | Rogers et al. |
| 4,140,549 | A | 2/1979 | Chia et al. |
| 4,189,334 | A | 2/1980 | Dubost et al. |
| 4,196,021 | A | 4/1980 | Bouvaist et al. |
| 4,305,763 | A | 12/1981 | Quist et al. |
| 4,462,843 | A | 7/1984 | Baba |
| 4,462,893 | A | 7/1984 | Moriya et al. |
| 4,477,292 | A | 10/1984 | Brown |
| 4,589,932 | A | 5/1986 | Park |
| 4,618,382 | A | 10/1986 | Miyagi et al. |
| 4,659,393 | A | 4/1987 | Bouvaist |
| 4,711,762 | A | 12/1987 | Vernam et al. |
| 4,828,631 | A | 5/1989 | Ponchel et al. |
| 4,927,470 | A | 5/1990 | Cho |
| 4,946,517 | A | 8/1990 | Cho |
| 4,954,188 | A | 9/1990 | Ponchel et al. |
| 4,976,790 | A | 12/1990 | McAuliffe et al. |
| 4,988,394 | A | 1/1991 | Cho |
| 5,108,520 | A | 4/1992 | Liu et al. |
| 5,186,235 | A | 2/1993 | Ward, Jr. |
| 5,213,639 | A | 5/1993 | Colvin et al. |
| 5,221,377 | A | 6/1993 | Hunt, Jr. et al. |
| 5,277,719 | A | 1/1994 | Kuhlman et al. |
| 5,312,498 | A | 5/1994 | Anderson |
| 5,313,639 | A | 5/1994 | Chao |
| 5,356,495 | A | 10/1994 | Wyatt-Mair et al. |
| 5,496,423 | A | 3/1996 | Wyatt-Mair et al. |
| 5,496,426 | A | 3/1996 | Murtha |
| 5,560,789 | A | 10/1996 | Sainfort et al. |
| 5,593,516 | A | 1/1997 | Cassada, III |
| 5,624,632 | A | 4/1997 | Baumann et al. |
| 5,681,405 | A | 10/1997 | Newton et al. |
| 5,718,780 | A | 2/1998 | Bryant et al. |
| 5,738,735 | A | 4/1998 | Bechet |
| 5,833,775 | A | 11/1998 | Newton et al. |

(Continued)

FOREIGN PATENT DOCUMENTS

| | | |
|---|---|---|
| DE | 68927149 | 4/1997 |

(Continued)

OTHER PUBLICATIONS

US Published Appln. No. 2002/043311 A1, (U.S. Appl. No. 09/975,675), Selepack et al., filed Oct. 10, 2001, published Apr. 18, 2002.

(Continued)

*Primary Examiner*—Roy King
*Assistant Examiner*—Jie Yang
(74) *Attorney, Agent, or Firm*—Novak Druce + Quigg LLP

(57) ABSTRACT

Disclosed is a Al—Zn alloy wrought product, and a method of manufacturing such a product, with an improved combination of high toughness and high strength by maintaining good corrosion resistance, the alloy including (in weight percent): Zn 6.0-11.0, Cu 1.4-2.2, Mg 1.4-2.4, Zr 0.05-0.15, Ti <0.05, Hf and/or V <0.25, and optionally Sc and/or Ce 0.05-0.25, and Mn 0.05-0.12, other elements each less than 0.05 and less than 0.50 in total, balance aluminium, wherein such alloy has an essentially fully unrecrystallized microstructure at least at the position T/10 of the finished product.

32 Claims, No Drawings

U.S. PATENT DOCUMENTS

| | | | | |
|---|---|---|---|---|
| 5,858,134 | A | 1/1999 | Bechet et al. | |
| 5,865,911 | A | 2/1999 | Miyasato et al. | |
| 5,865,914 | A | 2/1999 | Karabin et al. | |
| 5,888,320 | A | 3/1999 | Dorward | |
| 5,938,867 | A | 8/1999 | Dorward et al. | |
| 6,027,582 | A | 2/2000 | Shahani et al. | |
| 6,120,623 | A | 9/2000 | Gupta et al. | |
| 6,129,792 | A * | 10/2000 | Murtha | 148/437 |
| 6,224,992 | B1 | 5/2001 | Delbeke et al. | |
| 6,238,495 | B1 | 5/2001 | Haszler et al. | |
| 6,315,842 | B1 | 11/2001 | Shahani et al. | |
| 6,337,147 | B1 | 1/2002 | Haszler et al. | |
| 6,444,058 | B1 | 9/2002 | Liu et al. | |
| 6,543,122 | B1 | 4/2003 | Perkins et al. | |
| 6,562,154 | B1 | 5/2003 | Rioja et al. | |
| 6,569,542 | B2 | 5/2003 | Warner et al. | |
| 6,602,361 | B2 | 8/2003 | Warner et al. | |
| 6,627,330 | B1 | 9/2003 | Shimizu et al. | |
| 6,652,678 | B1 | 11/2003 | Marshall et al. | |
| 6,726,878 | B1 | 4/2004 | Flidlyander et al. | |
| 6,743,308 | B2 | 6/2004 | Tanaka et al. | |
| 6,790,407 | B2 * | 9/2004 | Fridlyander et al. | 420/532 |
| 6,972,110 | B2 | 12/2005 | Chakrabarti et al. | |
| 6,994,760 | B2 | 2/2006 | Benedictus et al. | |
| 7,060,139 | B2 | 6/2006 | Senkov et al. | |
| 7,097,719 | B2 | 8/2006 | Bray et al. | |
| 7,250,223 | B2 * | 7/2007 | Miyachi et al. | 428/654 |
| 7,294,213 | B2 | 11/2007 | Warner et al. | |
| 2001/0039982 | A1 | 11/2001 | Sigli | |
| 2002/0011289 | A1 | 1/2002 | Warner | |
| 2002/0162609 | A1 | 11/2002 | Warner | |
| 2003/0140990 | A1 | 7/2003 | Ribes | |
| 2003/0219353 | A1 | 11/2003 | Warner et al. | |
| 2004/0007295 | A1 | 1/2004 | Lorentzen et al. | |
| 2004/0062946 | A1 | 4/2004 | Benedictus et al. | |
| 2005/0067066 | A1 | 3/2005 | Tanaka et al. | |
| 2005/0081965 | A1 | 4/2005 | Benedictus | |
| 2005/0095447 | A1 | 5/2005 | Baumann | |
| 2006/0016523 | A1 | 1/2006 | Dif | |
| 2006/0174980 | A1 | 8/2006 | Benedictus et al. | |
| 2006/0182650 | A1 | 8/2006 | Eberl et al. | |
| 2007/0151636 | A1 | 7/2007 | Buerger | |
| 2007/0204937 | A1 | 9/2007 | Buerger | |
| 2008/0173377 | A1 | 7/2008 | Khosla | |
| 2008/0173378 | A1 | 7/2008 | Khosla | |
| 2008/0210349 | A1 | 9/2008 | Khosla | |
| 2009/0269608 | A1 | 10/2009 | Benedictus et al. | |
| 2009/0320969 | A1 | 12/2009 | Benedictus et al. | |

FOREIGN PATENT DOCUMENTS

| | | | |
|---|---|---|---|
| DE | 102004010700 | | 10/2004 |
| DE | 10392805 | | 6/2005 |
| EP | 0081441 | | 6/1983 |
| EP | 0368005 | | 5/1990 |
| EP | 0377779 | | 7/1990 |
| EP | 0587274 | | 3/1994 |
| EP | 0605947 | | 7/1994 |
| EP | 0670377 | | 9/1995 |
| EP | 0799900 | | 10/1997 |
| EP | 0829552 | | 3/1998 |
| EP | 0876514 | | 9/1998 |
| EP | 0989195 | | 3/2000 |
| EP | 1026270 | | 8/2000 |
| EP | 1045043 | | 10/2000 |
| EP | 1114877 | | 7/2001 |
| EP | 1143027 | | 10/2001 |
| EP | 1158068 | | 11/2001 |
| EP | 1170394 | | 1/2002 |
| EP | 1231290 | | 8/2002 |
| EP | 1306455 | | 5/2003 |
| EP | 1382698 | A1 | 1/2004 |
| FR | 1508123 | | 1/1968 |
| FR | 2066696 | | 8/1971 |
| FR | 2163281 | A5 | 7/1973 |
| FR | 2234375 | | 1/1975 |
| FR | 2409319 | | 6/1979 |
| FR | 2472618 | | 7/1981 |
| FR | 2716896 | | 9/1995 |
| FR | 2841263 | | 12/2003 |
| FR | 2846669 | | 5/2004 |
| FR | 2855834 | | 12/2004 |
| GB | 0925956 | | 5/1963 |
| GB | 1029486 | | 5/1966 |
| GB | 1231090 | | 5/1971 |
| GB | 1273261 | | 5/1972 |
| GB | 1427657 | | 5/1976 |
| GB | 2065516 | | 7/1981 |
| GB | 1603690 | | 11/1981 |
| GB | 2114601 | | 8/1983 |
| GB | 2430937 | | 4/2007 |
| JP | 61049796 | | 4/1986 |
| JP | 62010246 | | 1/1987 |
| JP | 62122744 | | 6/1987 |
| JP | 62122745 | | 6/1987 |
| JP | 63319143 | | 12/1988 |
| JP | 1039340 | | 2/1989 |
| JP | 1208438 | | 8/1989 |
| JP | 2047244 | | 2/1990 |
| JP | 06128678 | | 5/1994 |
| JP | 6228691 | | 8/1994 |
| JP | 8120385 | | 5/1996 |
| JP | 8144031 | | 6/1996 |
| JP | 59126762 | | 7/1998 |
| JP | 10280081 | | 10/1998 |
| JP | 10298692 | | 11/1998 |
| JP | 2001020028 | | 1/2001 |
| JP | 2001115227 | | 4/2001 |
| JP | 2002241882 | | 8/2002 |
| JP | 2003147498 | | 5/2003 |
| RU | 2044098 | C1 | 9/1995 |
| RU | 1 625 043 | A1 | 10/1995 |
| RU | 2165996 | C1 | 4/2001 |
| RU | 2184166 | C2 | 6/2002 |
| RU | 2215807 | C2 | 11/2003 |
| SU | 664 570 | A | 5/1979 |
| SU | 664570 | | 5/1979 |
| WO | 9203586 | | 3/1992 |
| WO | 9526420 | | 10/1995 |
| WO | 9610099 | | 4/1996 |
| WO | 9628582 | | 9/1996 |
| WO | 9629440 | | 9/1996 |
| WO | 9722724 | | 6/1997 |
| WO | 9837251 | | 8/1998 |
| WO | 0054967 | | 9/2000 |
| WO | 0210468 | | 2/2002 |
| WO | 0210468 | A | 2/2002 |
| WO | 02052053 | | 7/2002 |
| WO | 02075010 | | 9/2002 |
| WO | 03076677 | | 9/2003 |
| WO | 03085145 | | 10/2003 |
| WO | 03085146 | | 10/2003 |
| WO | 2004001080 | | 12/2003 |
| WO | 2004111282 | | 12/2004 |
| WO | 2005003398 | | 1/2005 |

OTHER PUBLICATIONS

US Published Appln. No. 2005/0072497, (U.S. Appl. No. 10/406,610), Eberl et al, filed Apr. 4, 2003, published Apr. 7, 2005.

US Published Appln. No. 2004/0109787 A1, (U.S. Appl. No. 10/725,501), Haszler et al., filed Dec. 3, 2003, published Jun. 10, 2004.

US Published Appln. No. 2005/0189044 A1, (U.S. Appl. No. 10/821,184), Benedictus et al., Filed Apr. 9, 2004, published Sep. 1, 2005.

US Published Appln. No. 2002/0121319 A1, (U.S. Appl. No. 09/971,456), Chakrabarti et al., Filed Oct. 4, 2001, published Sep. 5, 2002.

US Published Appln. No. 2002/0150498, (U.S. Appl. No. 09/773,270), Chakrabarti et al., filed Jan. 31, 2001, published Oct. 17, 2002.

US Published Appln. No. 2001/0006082, (U.S. Appl. No. 09/734,661), Warner et al., filed Dec. 13, 2000, published Jul. 5, 2001.

US Published Appln. No. 2002/0014290, (U.S. Appl. No. 09/826,289), Dif et al., filed Apr. 5, 2001, published Feb. 7, 2002.

US Published Appln. No. 2002/0039664, (U.S. Appl. No. 09/873,031), Magnusen et al., filed Jun. 1, 2001, published Apr. 4, 2002.

US Published Appln. No. 2004/0101434 A1, (U.S. Appl. No. 10/333,334) Fridlyander et al., filed Jul. 25, 2001, published May 27, 2004.

US Published Appln. No. 2002/014288, (U.S. Appl. No. 09/479,924), Warner et al., filed Jan. 10, 2000, published Feb. 7, 2002.

Machine translation of excerpts of published PCT patent application No. WO 95/26,420, published Oct. 1995.

"Heat Treating of Aluminum Alloys," ASM Handbook, vol. 4, pp. 841-856, 1995.

US Published Appln. No. 2005/0034794 A1, (U.S. Appl. No. 10/819,130), Benedictus et al., filed Apr. 7, 2004, published Feb. 17, 2005.

US Published Appln. No. 2006/0032560 A1, (U.S. Appl. No. 10/976,154), Benedictus et al., filed Oct. 29, 2004, published Feb. 16, 2006.

US Published Appln. No. 2004/0211498 A1, (U.S. Appl. No. 10/787,257), Keidel et al., filed Feb. 27, 2004, published Oct. 28, 2004.

Office Action of Sep. 20, 2007 of U.S. Appl. No. 10/976,154 to Benedictus et al.

Office Action of Jun. 22, 2007 of U.S. Appl. No. 10/819,130 to Benedictus et al.

Office Action of Jun. 26, 2007 of U.S. Appl. No. 10/821,184 to Benedictus et al.

US Published Patent Application No. 2002/0162609A1, (U.S. Appl. No. 10/066,788), Warner, filed Feb. 6, 2002, published Nov. 7, 2002.

US Published Patent Application No. 2003/0219353A1, (U.S. Appl. No. 10/406,609), Warner et al., filedApr. 4, 2003, published Nov. 27, 2003.

US Published Patent Application No. 2002/0153072 A1, (U.S. Appl. No. 10/003,515), Tanaka et al., filed Nov. 2, 2001, published Oct. 24, 2002.

US Published Patent Application No. 2005/0006010 A1, (U.S. Appl. No. 10/456,183), Benedictus et al., filed Jun. 9, 2003, published Jan. 13, 2005.

US Published Patent Application No. 2007/0000583 A1, (U.S. Appl. No. 10/334,388), Rioja et al., filed Dec. 31, 2002, published Jan. 4, 2007.

Lakhtin Yu. M. et al., Material Science, Moscow, "Machine Construction," 1980, p. 40.

English-language translation of a claim of SU 664 570 A, published May 25, 1979.

English-language translation of the Abstract of SU 1625 043 A1, published Oct. 20, 1995.

English-language translation of Lakhtin, Yu. M. et al., Material Science, Moscow, "Machine Construction," 1980, p. 40.

V.I. Dobatkin, Smelting and Casting of Aluminum Alloys, Moscow, "Metallurgy," 1970, p. 27.

The Russian State Standard GOST 4784-97. Aluminum and wrought aluminum alloys. Grades, Minsk, Publisher or Standards, 1999, p. 7, 8, table 6.

ASM Specialty Handbook Aluminum and Aluminum Alloys, J.R. Davis, ASM International Handbook Committee, pp. 290-295 and 319-320 copyright 1993.

Aluminum Properties and Physical Metallurgy, John E. Hatch, American Society for Metals, pp. 150-157 copyright 1984.

International Alloy Designations and Chemical Composition Limits for Wrought Aluminum and Wrought Aluminum Alloys (teal sheets), The Aluminum Association, miscellaneous annotated pages (Jul. 1998).

"Aluminum Viewed from Within", Altenpol, 1st edition, pp. 118-131 (1982).

ASM Specialty Handbook, Aluminum and Aluminum Alloys, edited by J.R. Davis, ASM International, pp. 247-248 (1993).

Aluminum Properties and Physical Metallurgy, edited by J.E. Hatch, American Society for Metals, p. 112-113 (1984).

Aluminum-Taschenbuch 15. Auflage, Dorossel et al., p. 20-25 (1999).

Airbus Industrie Material Specification AIMS 03-02-020 Feb. 2002).

Hufnagel W: "Key to aluminum alloys, 4th edition" 1991, pp. 195-205, XP002194851.

* cited by examiner

HIGH-STRENGTH, HIGH TOUGHNESS AL-ZN ALLOY PRODUCT AND METHOD FOR PRODUCING SUCH PRODUCT

CROSS-REFERENCE TO RELATED APPLICATIONS

This claims priority from U.S. provisional patent application Ser. No. 60/616,227 filed Oct. 7, 2004 and European patent application no. 04077721.1 filed Oct. 5, 2004, both incorporated herein by reference in their entirety.

FIELD OF THE INVENTION

The present invention relates to a high-strength high-toughness Al—Zn alloy wrought product with elevated amounts of Zn for maintaining good corrosion resistance, and to a method for producing such a high-strength high-toughness Al—Zn alloy product and to a plate product of such alloy. More specifically, the present invention relates to a high strength, high toughness Al—Zn alloy designated by the AA7000-series of the international nomenclature of the Aluminum Association for structural aeronautical applications. Even more specifically, the present invention relates to a new chemistry window for an Al—Zn alloy having improved combinations of strength and toughness by maintaining good corrosion resistance, which does not need specific ageing or temper treatments.

BACKGROUND OF THE INVENTION

It is known in the art to use heat treatable aluminium alloys in a number of applications involving relatively high strength, high toughness and corrosion resistance such as aircraft fuselages, vehicular members and other applications. Aluminium alloys AA7050 and AA7150 exhibit high strength in T6-type tempers. Also precipitation-hardened AA7×75, AA7×55 alloy products exhibit high strength values in the T6 temper. The T6 temper is known to enhance the strength of the alloy, wherein the aforementioned AA7×50, AA7×75 and AA7×55 alloy products which contain high amounts of zinc, copper and magnesium are known for their high strength-to-weight ratios and, therefore, find application in particular in the aerospace industry. However, these applications result in exposure to a wide variety of climatic conditions necessitating careful control of working and ageing conditions to provide adequate strength and resistance to corrosion, including both stress corrosion and exfoliation.

In order to enhance resistance against stress corrosion and exfoliation as well as fracture toughness it is known to artificially over-age these AA7000-series alloys. When artificially aged to a T79, T76, T74 or T73-type temper their resistance to stress corrosion, exfoliation corrosion and fracture toughness improve in the order stated (T73 being best and T79 being close to T6) but at the cost of strength compared to the T6 temper condition. A more acceptable temper condition is the T74-type temper which is a limited over-aged condition, between T73 and T76, in order to obtain an acceptable level of tensile strength, stress corrosion resistance, exfoliation corrosion resistance and fracture toughness. Such T74 temper is performed by over-ageing the aluminium alloy product at temperatures of 121° C. for 6 to 24 hours and followed by 171° C. for about 14 hours.

Depending on the design criteria for a particular aircraft component even small improvements in strength, toughness or corrosion resistance result in weight savings, which translate amongst others to fuel economy over the life time of the aircraft. To meet these demands several other 7000-series alloys have been developed.

For example each of EP-0377779, U.S. Pat. No. 5,221,377 and U.S. Pat. No. 5,496,426 disclose alloy products and an improved process for producing an 7055 alloy for sheet or thin plate applications in the field of aerospace such as upper-wing members with high toughness and good corrosion properties which comprises the steps of working a body having a composition consisting of, about in wt.%: Zn 7.6 to 8.4, Cu 2.2 to 2.6, Mg 1.8 to 2.1 or 2.2, and one or more elements selected from Zr, Mn V and Hf, the total of the elements not exceeding 0.6 wt. %, the balance aluminium plus incidental impurities, solution heat treating and quenching the product and artificially ageing the product by either heating the product three times in a row to one or more temperatures from 79° C. to 163° C. or heating such product first to one or more temperatures from 79° C. to 141° C. for two hours or more and heating the product to one or more temperatures from 148° C. to 174° C. These products are reported to have an improved exfoliation corrosion resistance of "EB" or better with about 15% greater yield strength than similar sized 7×50 counter-parts in the T76-temper condition. They still have at least about 5% higher strength than their similar-sized 7×50-T77 counterpart (7150-T77 will be used herein below as a reference alloy).

SUMMARY OF THE INVENTION

It is a preferred object of the present invention to provide an improved Al—Zn alloy preferably for plate products with high (compressive) strength and high toughness. Corrosion resistance should not deteriorate.

More specifically, it is an object of the present invention to provide an alloy product which can be used for upper wing applications in aerospace with an improved compression yield strength and a high unit propagation energy with properties which are better than the properties of a conventional AA7055-alloy in the T77 temper.

It is another object of the invention to obtain an AA7000-series aluminium alloy which exhibits strength in the range of T6-type tempers and toughness and corrosion resistance properties in the range of T73-type tempers.

It is another object of the invention to provide a method of manufacturing the aluminium alloy product according to this invention.

The present invention relates to a Al—Zn alloy wrought product, and a to method of manufacturing such a product, with an improved combination of high toughness and high strength by maintaining good corrosion resistance, the alloy including (in weight percent): Zn 6.0-11.0, Cu 1.4-2.2, Mg 1.4-2.4, Zr 0.05-0.15, T <0.05, Hf and/or V <0.25, and optionally Sc and/or Ce 0.05-0.25, and Mn 0.05-0.12, other elements each less than 0.05 and less than 0.50 in total, balance aluminium, wherein such alloy has an essentially fully unrecrystallized microstructure at least at the position T/10 of the finished product.

DETAILED DESCRIPTION OF THE PREFERRED EMBODIMENTS

As will be appreciated hereinbelow, except as otherwise indicated, alloy designations and temper designations refer to the Aluminum Association designations in Aluminum Standards and Data and the Registration Records, all published by the US Aluminum Association.

One or more of the above mentioned objects of the invention are achieved by using an Al—Zn alloy product with an improved combination of high toughness and high strength by maintaining good corrosion resistance, said alloy comprising, and preferably consisting of, (in weight percent):

Zn 6.0 to 11.0
Cu 1.4 to 2.2
Mg 1.4 to 2.4
Zr 0.05 to 0.15
Ti <0.05,
Hf and/or V <0.25,
optionally Sc and/or Ce 0.05 to 0.25, and
optionally Mn 0.05 to 0.12,
and inevitable impurities and balance aluminium, preferably other elements each less than 0.05 and less than 0.50 in total, and wherein the alloy product has a substantially fully unrecrystallized microstructure at the position T/10 of the finished product.

Such chemistry window for an AA7000-series alloy exhibits excellent properties when produced to relatively thin plate products, and which is preferably useable in aerospace upper-wing applications having gauges in the range of 20 mm to 60 mm.

The above defined chemistry has properties which are comparable or better than existing alloys of the AA7×50 or AA7×55 series in the T77-temper, without using the above described cumbersome and complicated T77 three-step ageing cycles. The chemistry leads to an aluminium product which is more cost effective and is also simpler to produce since less processing steps are necessary. Additionally, the chemistry allows new manufacturing techniques like age forming or age creep forming which is not feasible when a T77-temper alloy is applied. Even better, the chemistry as defined above can also be aged to the T77-temper whereby the corrosion resistance further improves.

According to the invention it has been found that a selected range of elements, using a higher amount of Zn and a specific combination of a particular range of Mg and Cu, exhibit substantially better combinations of strength and toughness and maintaining a good corrosion performance such as exfoliation corrosion resistance and stress corrosion cracking resistance.

The present invention uses the chemistry also in combination with a method to produce a rolled product from such chemistry, as explained herein below, to obtain a substantially fully unrecrystallized microstructure at least at the position T/10 of the finished product. More preferably the product is unrecystallized across the whole thickness. With unrecystallized we mean that more than 80%, preferably more than 90% of the gauge of the finished rolled product is substantially unrecrystallized. Hence, the present invention is disclosing an alloy product which is in particular suitable for upper wing skin applications for aircrafts and having a thickness in the range of 20 to 60 mm, preferably 30 to 50 mm.

It has been found that it is not necessary to slowly quench the rolled product or to increase the gauge of the rolled product to obtain superior compression yield strength and toughness properties.

Copper and magnesium are important elements for adding strength to the alloy. Too low amounts of magnesium and copper result in a decrease of strength while too high amounts of magnesium and copper result in a lower corrosion performance and problems with the weldability of the alloy product. Prior art techniques used special ageing procedures to ameliorate the strength while low amounts of magnesium and copper are used in order to achieve a good corrosion performance. In order to achieve a compromise in strength, toughness and corrosion performance copper and magnesium amounts (in wt. %) of between 1.7 and 2.2%, preferably between 1.7 and 2.1% for Mg and 1.8 and 2.1% for Cu have been found to give a good balance for thin plate products. Throughout the claimed chemistry of the present invention it is now possible to achieve strength levels in the region of a T6-temper alloy while maintaining corrosion performance characteristics similar to those of T74-temper alloys.

Apart from the amounts of magnesium and copper the invention discloses a balance of magnesium and copper amounts to zinc, especially the balance of magnesium to zinc, which gives the alloy these performance characteristics. The improved corrosion resistance of the alloy according to the invention has exfoliation properties ("EXCO") of EB or better, preferably EA or better.

The amount (in weight %) of zinc is preferably in a range of 7.4 to 9.6%, more preferably in a range of 8.0 to 9.6%, most preferably in a range of 8.4 to 8.9%. Testing has found an optimum zinc level of about 8.6%. Further details are given in the examples as described in more details hereinbelow.

It has furthermore been shown that, according to a preferred embodiment of the present invention, a Sc-containing alloy is an excellent candidate for obtaining high strength versus high notch toughness levels. By adding Sc to an alloy comprising copper, magnesium, zinc, zirconium and titanium it has been found that the microstructure remains unrecrystallized, thereby showing superior properties with regard to strength and toughness. Hence, preferred amounts of Sc (in weight %) are in a range of [Zr]+1.5 [Sc]<0.15%. Preferred amounts (in weight %) of Sc or Ce are in a range of 0.03 to 0.06% when the amount of Zn is about 8.70% and Mg and Cu are about 2.10%. The levels of the unit propagation energy are considerably good for an alloy with additional Sc, Ce or Mn alloying elements.

A preferred method for producing a high strength, high toughness Al—Zn alloy product with good corrosion resistance according to the present invention comprises the steps of a. casting an ingot with the following composition (in weight percent):

Zn 6.0 to 11.0
Cu 1.4 to 2.2
Mg 1.4 to 2.4
Zr 0.05 to 0.15
Ti <0.05,
Hf and/or V <0.25,
optionally Sc and/or Ce 0.05 to 0.25, and
optionally Mn 0.05 to 0.12, and inevitable impurities and balance aluminium, preferably other elements each less than 0.05 and less than 0.50 in total, b. homogenising and/or pre-heating the ingot after casting, c. hot working the ingot into a pre-worked product, d. reheating the pre-worked product, and either d1. hot rolling the reheated product to the final gauge, or d2 hot rolling and cold rolling the reheated product to the final gauge, e. solution heat treating and quenching the solution heat treated product, f. optionally stretching or compressing of the quenched alloy product or otherwise cold worked to relieve stresses, and g. optionally ageing the quenched and optionally stretched or compressed product to achieve a desired temper, and wherein the alloy product has a substantially fully unrecrystallized microstructure at the position T/10 of the finished product.

It has been found that the microstructure of the alloy product remains substantially fully unrecrystallized underneath its surface when the inventive method step of pre-working the product and hot rolling and/or or cold rolling the pre-worked product are applied.

In accordance with an embodiment of the present invention the method includes a first hot rolling of the ingot which has been homogenised into a pre-worked product, hot rolling the re-heated product to about 150 to 250 (in final-gauge %) and then cold rolling the hot rolled product to the final gauge or hot rolling the re-heated product to about 105 to 140 (in final-gauge %) and then cold rolling the hot rolled product to the final gauge. "Final-gauge %" means a percentage in thickness compared to the thickness of the final product. 200 final-gauge % means a thickness which is twice as much as the thickness of the finally worked product. That means that it has been found that it is advantageous to first hot roll the pre-heated product to a thickness which is about twice as high as the thickness of the final product and then cold rolling the hot rolled product to the final thickness or to hot roll the pre-heated product to a thickness which is about 20% higher than the thickness of the final product and then cold rolling the product, thereby obtaining another about 20% reduction of the gauge of the hot rolled product.

According to another embodiment of the present invention it is advantageous to hot roll the re-heated product at low temperatures in the range of 300° C. to 420° C. so that the alloy does not recrystallise. Optionally, it is possible to artificially ageing the worked and heat-treated product with a two-step T79 or T76 temper or to use a T77-three step temper if SCC performance shall be improved.

The present invention is useful for hot-working the ingot after casting and optionally cold-working into a worked product with a gauge in the range of 20 to 60 mm.

The present invention also concerns a plate product of high strength, high toughness Al—Zn alloy of the aforementioned composition which plate product is preferably a thin aircraft member, even more preferably an elongate structural shape member such as an upper-wing member, a thin skin member of an upper-wing or of a stringer of an aircraft.

The properties of the claimed alloy may further be enhanced by an artificial ageing step comprising a first heat treatment at a temperature in a range of 105° C. to 135° C., preferably around 120° C. for 2 to 20 hours, preferably around 8 hours and a second heat treatment at a higher temperature then 135° C. but below 210° C., preferably around 155° C. for 4 to 12 hours, preferably 8 to 10 hours.

The foregoing and other features and advantages of the alloys according to the present invention will become readily apparent from the following detailed description of preferred embodiments.

EXAMPLES

Example 1

On a laboratory scale 14 different aluminium alloys have been cast into ingots, homogenised, pre-heated for more than 6 hours at about 410° C. and hot rolled to 4 mm plates. Solution heat treatment was done at 475° C. and thereafter water quenched. Thereafter, the quenched product was aged by a two-step T76 ageing procedure. The chemical compositions are set out in Table 1.

TABLE 1

Chemical compositions of alloys in thin plate form, in weight %, balance aluminium and inevitable impurities, Fe 0.06, Si 0.05, Ti 0.04 and Zr 0.12.

| Alloy | Cu | Mg | Zn | Others |
|---|---|---|---|---|
| 1 | 2.0 | 2.1 | 8.0 | 0.08 Mn |
| 2 | 2.1 | 2.1 | 8.1 | — |
| 3 | 1.7 | 1.75 | 8.7 | — |
| 4 | 2.1 | 1.7 | 8.6 | — |
| 5 | 2.4 | 1.7 | 8.6 | — |
| 6 | 1.7 | 2.2 | 8.7 | — |
| 7 | 2.1 | 2.1 | 8.6 | — |
| 8 | 2.4 | 2.1 | 8.7 | — |
| 9 | 1.7 | 2.5 | 8.7 | — |
| 10 | 2.1 | 2.4 | 8.6 | — |
| 11 | 2.5 | 2.5 | 8.7 | — |
| 12 | 2.1 | 2.1 | 9.2 | — |
| 13 | 2.1 | 2.1 | 8.7 | 0.03 Ce |
| 14 | 2.1 | 2.1 | 8.7 | 0.06 Sc |

The alloys of Table 1 were processed using three processing variants (see step 5):

1. Homogenisation was performed by heating at a temperature rate of 40° C./h to a temperature of 460° C., then soaking for 12 hours at 460° C. and another increase with 25° C./h to a temperature of 475° C. with another soaking for 24 hours at 475° C., and air cooling to room temperature.
2. Pre-heating was done at 420° C. for 6 hours with a heating rate of 40° C./h.
3. The lab scale ingots were hot rolled from 80 to 25 mm, thereby reducing the gauge by about 6 to 8 mm per pass.
4. The 25 mm thick products were reheated to 420° C. for about 30 min.
5. Variant 1: The reheated product was hot rolled to 4.0 mm.
   Variant 2: The reheated product was hot rolled to 8.0 mm and thereafter cold rolled to 4.0 mm.
   Variant 3: The reheated product was hot rolled to 5.0 mm and then cold rolled to 4.0 mm.
6. Solution heat treatment was done for 1 hour at 475° C., thereafter water quenched.
7. Stretching was done by 1.5 to 2.0% within about 1 hour after quenching.
8. Thereafter, the stretched products were aged in accordance with a T76 ageing procedure, thereby raising the temperature to 120° C. at a rate of 30° C./h and maintaining the temperature at 120° C. for 5 hours, raising the temperature at a rate of 15° C./h to a temperature of 160° C. and soaking for 6 hours, and air cooling the aged product to room temperature.

Strength was measured using small Euronorm and toughness were measured in accordance with ASTM B-871(1996). The results of the three above-mentioned variants are shown in Table 2a to 2c.

TABLE 2a

Strength and toughness properties of the alloys as shown in Table 1 in MPa and notch toughness (TYR) in accordance with Variant 1.

| Alloy | Rp | UPE | TYR |
|---|---|---|---|
| 1 | 582 | 211 | 1.31 |
| 2 | 564 | 215 | 1.48 |
| 3 | 534 | 243 | 1.49 |
| 4 | 550 | 214 | 1.48 |
| 5 | 579 | 208 | 1.44 |
| 6 | 592 | 84 | 1.34 |

TABLE 2a-continued

Strength and toughness properties of the alloys as shown in Table 1 in MPa and notch toughness (TYR) in accordance with Variant 1.

| Alloy | Rp | UPE | TYR |
|---|---|---|---|
| 7 | 595 | 120 | 1.32 |
| 8 | 605 | 98 | 1.32 |
| 9 | 612 | 30 | 1.31 |
| 10 | 613 | 54 | 1.12 |
| 11 | 603 | 33 | 1.11 |
| 12 | — | — | — |
| 13 | 597 | 163 | 1.27 |
| 14 | 587 | 121 | 1.35 |

TABLE 2b

Strength and toughness properties of the alloys as shown in Table 1 in MPa and notch toughness (TYR) in accordance with Variant 2.

| Alloy | Rp | UPE | TYR |
|---|---|---|---|
| 1 | 599 | 125 | 1.30 |
| 2 | 567 | 268 | 1.45 |
| 3 | 533 | 143 | 1.53 |
| 4 | 587 | 205 | 1.38 |
| 5 | 563 | 178 | 1.45 |
| 6 | 569 | 134 | 1.35 |
| 7 | — | — | — |
| 8 | 616 | 72 | 1.10 |
| 9 | — | — | — |
| 10 | 601 | 22 | 1.00 |
| 11 | 612 | 5 | 1.05 |
| 12 | — | — | — |
| 13 | 595 | 88 | 1.16 |
| 14 | 626 | 71 | 1.26 |

TABLE 2c

Strength and toughness properties of the alloys as shown in Table 1 in MPa and notch toughness (TYR) in accordance with Variant 3.

| Alloy | Rp | UPE | TYR |
|---|---|---|---|
| 1 | 600 | 170 | 1.35 |
| 2 | 575 | 211 | 1.47 |
| 3 | 535 | 232 | 1.59 |
| 4 | 573 | 260 | 1.46 |
| 5 | 604 | 252 | 1.39 |
| 6 | 587 | 185 | 1.43 |
| 7 | 613 | 199 | 1.26 |
| 8 | 627 | 185 | 1.18 |
| 9 | — | — | — |
| 10 | 607 | 31 | 1.09 |
| 11 | 614 | 26 | 0.92 |
| 12 | 606 | 58 | 1.11 |
| 13 | 601 | 148 | 1.26 |
| 14 | 616 | 122 | 1.35 |

From the results presented in Tables 2a to 2c it is clear that a minor degree (10 to 20%) of cold rolling is beneficial for an optimum toughness versus strength balance. The purely hot rolled material in accordance with Variant 1 (Table 2a) is close to the optimum but in general the Variant 3-alloys are better.

Furthermore, it can be seen that Sc-containing alloy 14 is advantageous if high strength versus high notch toughness is needed. Small amounts of manganese do increase the strength but at the cost of some toughness.

Example 2

Additional chemistries have been processed in accordance with the above-mentioned processing steps 1 to 8, thereby using the variant 3 of step 5 of example 1 above and a T76 ageing.

TABLE 3

Chemical compositions of thin plate alloys, in weight %, for all alloys balance aluminium and inevitable impurities, Fe 0.06, Si 0.05.

| Alloy | Cu | Mg | Zn | Zr | Ti | Others |
|---|---|---|---|---|---|---|
| 1 | 2.0 | 2.1 | 8.0 | 0.11 | 0.03 | 0.08 Mn |
| 2 | 2.1 | 2.1 | 8.1 | 0.12 | 0.03 | — |
| 3 | 1.7 | 2.2 | 8.7 | 0.12 | 0.03 | — |
| 4 | 2.1 | 2.1 | 8.6 | 0.12 | 0.03 | — |
| 5 | 2.4 | 2.1 | 8.7 | 0.12 | 0.03 | — |
| 6 | 2.1 | 2.1 | 9.2 | 0.12 | 0.03 | — |
| 7 | 2.1 | 2.1 | 8.7 | 0.12 | 0.04 | 0.04 Ce |
| 8 | 2.1 | 2.1 | 8.7 | 0.10 | 0.04 | 0.06 Sc |
| 9 | 1.7 | 2.1 | 9.3 | 0.12 | 0.03 | — |
| 10 | 1.6 | 2.5 | 9.2 | 0.12 | 0.04 | — |
| 11 | 2.1 | 2.4 | 9.2 | 0.12 | 0.04 | — |

The properties of the alloys mentioned in Table 3 have been tested in the L-direction for the strength and in the L-T-direction for the toughness.

TABLE 4

Strength and toughness properties of the alloys as shown in Table 3 in MPa and notch toughness (TS/Rp) in accordance with Variant 3.

| Alloy | Rp (MPa) | Rm (MPa) | UPE ($kJ/m^2$) | TS/Rp |
|---|---|---|---|---|
| 1 | 601 | 637 | 177 | 1.35 |
| 2 | 575 | 603 | 221 | 1.48 |
| 3 | 591 | 610 | 194 | 1.45 |
| 4 | 613 | 647 | 199 | 1.34 |
| 5 | 624 | 645 | 178 | 1.18 |
| 6 | 608 | 638 | 63 | 1.13 |
| 7 | 601 | 639 | 163 | 1.27 |
| 8 | 618 | 652 | 132 | 1.35 |
| 9 | 613 | 632 | 75 | 1.25 |
| 10 | 618 | 650 | 5 | 1.29 |
| 11 | 619 | 654 | 26 | 1.18 |

The toughness versus tensile yield strength (Rp) shown in Table 4 clearly shows that the best toughness versus tensile yield strength value is obtained for alloys having around 8.6 to 8.7 weight % zinc. Alloys with lower levels of zinc will show similar toughness values but the tensile strength is—generally speaking—lower whereas high levels of zinc result in higher strength levels but lower toughness levels. Small amounts of manganese do increase the strength at the cost of toughness.

Example 3

Further tests were done with zinc levels of 8.6 and 8.7 wt. % thereby varying copper and magnesium levels. It can be shown that toughness levels can be elevated at the same strength levels. Some additional alloys were processed similar as to the ones in Example 2, thereby using the processing steps 1 to 8 as described above and Variant 3 of step 5 of Example 1.

TABLE 5

Chemical compositions of thin plate alloys, in weight %, for all alloys balance aluminium and inevitable impurities, Fe 0.06, Si 0.05.

| Alloy | Cu | Mg | Zn | Zr | Ti | Others |
|---|---|---|---|---|---|---|
| 3 | 1.7 | 2.2 | 8.7 | 0.12 | 0.03 | — |
| 4 | 2.1 | 2.1 | 8.6 | 0.12 | 0.03 | — |
| 5 | 2.4 | 2.1 | 8.7 | 0.12 | 0.03 | — |
| 12 | 2.5 | 2.5 | 8.7 | 0.11 | 0.03 | 0.08 Mn |
| 13 | 2.1 | 2.4 | 8.6 | 0.12 | 0.03 | — |
| 14 | 1.7 | 2.5 | 8.7 | 0.12 | 0.03 | — |
| 15 | 1.7 | 1.7 | 8.7 | 0.12 | 0.03 | — |
| 16 | 2.4 | 1.7 | 8.6 | 0.12 | 0.03 | — |
| 17 | 2.1 | 1.7 | 8.6 | 0.12 | 0.04 | — |

TABLE 6

Strength and toughness properties of the alloys as shown in Table 5 in MPa and notch toughness (TS/Rp) in accordance with Variant 3.

| Alloy | Rp (MPa) | UPE ($kJ/m^2$) | TS/Rp |
|---|---|---|---|
| 3 | 591 | 194 | 1.45 |
| 4 | 613 | 199 | 1.34 |
| 5 | 624 | 178 | 1.18 |
| 12 | 614 | 26 | 0.92 |
| 13 | 607 | 31 | 1.09 |
| 14 | 621 | 55 | 1.01 |
| 15 | 535 | 232 | 1.59 |
| 16 | 604 | 252 | 1.39 |
| 17 | 573 | 260 | 1.46 |

As shown in Table 6 it is advantageous to have magnesium levels of less than 2.4% with an optimum of about 1.7%. When magnesium levels are at about 1.7%, excellent toughness properties are obtained but the strength levels decrease. With magnesium levels of about 2.1% the best strength levels are obtained. Hence, magnesium is best in between 1.7 and 2.1%.

All above mentioned alloys have been tested on exfoliation corrosion according to ASTM G-34. They all showed a performance of EB or better.

Furthermore, it has been shown that the addition of Ce or Sc enhances the microstructure of the alloy thereby reducing recovery processes. Since the recovery within the allow material is low, nearly no recrystallization takes place even though a solution heat treatment is used in accordance with the standard route. Sc represses recrystallization so that usually more than 90% of the thickness of the thin plate products remains unrecrystallized.

According to another embodiment of the present invention it is advantageous to hot roll the re-heated product at low temperatures in the range of 300° C. to 420° C. so that the alloy does not recrystallise. Optionally, it is possible to artificially age the worked and heat-treated product with a two-step T79 or T76 temper or to use a T77-three step temper if SCC performance shall be improved.

The invention claimed is:

1. Method for producing a high strength, high toughness Al—Zn alloy product with good corrosion resistance, consisting of the sequential steps of:

a) casting an ingot with the following composition, in weight percent:
Zn 6.0 to 11.0%
Cu 1.4 to 2.2%
Mg 1.4 to 2.4%
Zr 0.05 to 0.15%
Ti <0.05%
Hf and/or V <0.25%,
optionally Sc and/or Ce 0.05 to 0.25%,
optionally Mn 0.05 to 0.12%, and
inevitable impurities and balance aluminium, b) homogenising or pre-heating the ingot after casting, c) in a first hot rolling step, hot rolling the homogenised or pre-heated ingot into a pre-worked product, d) reheating the pre-worked product, and then in a second hot rolling step hot rolling the reheated product to a thickness in a range selected from the group consisting of about 150 to 250 (in final-gauge %) or about 105 to 140 (in final-gauge %) at low temperatures in the range of 300° C. to 420° C. to prevent the alloy product from recrystallising and then, after the second hot rolling step, cold rolling the reheated product to a final gauge, wherein the final gauge has a thickness of from 4 to 60 mm, e) solution heat-treating the cold-rolled product and quenching the solution heat-treated product, f) optionally stretching or compressing of the quenched alloy product, g) artificially ageing the reheated, hot- and cold-rolled, solution heat-treated, quenched and optionally stretched or compressed alloy product by a two-step ageing treatment to produce the alloy product to have a T79 or T76 temper, wherein the first ageing step is at a temperature in a range of 105 to 135° C. for 2 to 20 hours and the second ageing step is at a temperature higher than 135° C. but less than 210° C. for 4 to 12 hours to a temper selected from T79 and T76 temper, and wherein more than 80% of the gauge of the artificially aged alloy product has a substantially unrecrystallised microstructure.

2. Method according to claim 1, wherein the artificial ageing during step g) consists of a first ageing step at a temperature around 120° C. for 2 to 20 hours and a second ageing step at a temperature higher than 135° C. but less than 210° C. for 4 to 12 hours to a temper selected from T79 and T76 temper.

3. Method according to claim 1, wherein the artificial ageing during step g) consists of a first ageing step at a temperature around 120° C. for 2 to 20 hours and a second ageing step at a temperature around 155° C. to 160° C. for 4 to 12 hours to a temper selected from T79 and T76 temper.

4. Method according to claim 1, wherein the amount of Zn is in a range of 7.4 to 9.6 wt. %.

5. Method according to claim 1, wherein the amount of Zn is in a range of 8.0 to 9.6 wt. %.

6. Method according to claim 1, wherein the amount of Zn is in a range of 7.4 to 8.9 wt. %.

7. Method according to claim 1, wherein the amount of Zn is in a range of 8.4 to 8.9 wt. %.

8. Method according to claim 1, wherein the amount of Cu is in a range of 1.7 to 2.2 wt. %.

9. Method according to claim 1, wherein the amount of Cu is in a range of 1.8 to 2.1 wt. %.

10. Method according to claim 1, wherein the amount of Mg is in a range of 1.7 to 2.2 wt. %.

11. Method according to claim 1, wherein the amount of Mg is in a range of 1.7 to 2.1 wt. %.

12. Method according to claim 1, wherein the amount of Sc is in a range of [Zr]+1.5 [Sc]<0.15 wt. %.

13. Method according to claim 1, wherein the amount of Sc is in a range of 0.03 to 0.06 wt. %.

14. Method according to claim 1, wherein the amount of Ce is in a range of 0.03 to 0.06 wt. %.

15. Method according to claim 1, wherein the amount of inevitable impurities are <0.5 wt. % in total.

16. Method according to claim 1, wherein the amount of inevitable impurities are <0.05 wt. % each.

17. Method according to claim 1, wherein the finished rolled product of more than 90% of the gauge has a substantially unrecrystallised microstructure.

18. Method according to claim 1, wherein the Al—Zn product is a thin plate having a gauge in a range of 20 to 60 mm.

19. Method according to claim 1, wherein the Al—Zn product is a thin plate having a gauge in the range of 30 to 50 mm.

20. Method according to claim 1, wherein the Al—Zn product is a thin aircraft member and wherein the reheated product is hot-rolled and then the hot-rolled product is cold rolled 10 to 20% to the final gauge.

21. Method according to claim 1, wherein the Al—Zn product is an upper-wing member of an aircraft.

22. Method according to claim 1, wherein the Al—Zn product is a thin skin member of an upper-wing or of a stringer of an aircraft.

23. Method according to claim 1, wherein Al—Zn product is stringer of an aircraft.

24. Method according to claim 1, wherein the ingot consists essentially of the following composition, in weight percent:

Zn 6.0 to 11.0%
Cu 1.4 to 2.2%
Mg 1.4 to 2.4%
Zr 0.05 to 0.15%
Ti <0.05%
Hf and/or V <0.25%
optionally Sc and/or Ce 0.05 to 0.25%,
optionally Mn 0.05 to 0.12%, and
inevitable impurities and balance aluminium.

25. Method according to claim 1, wherein the method performed from step (b) through (e) consists essentially of steps (b), (c), (d) and (e).

26. Method according to claim 1, wherein the method performed from step (b) through (e) consists of steps (b), (c), (d) and (e).

27. Method according to claim 26, wherein the reheated product is hot rolled to about 105 to 140 (in final-gauge %) and then the hot rolled product is cold rolled to the final gauge.

28. Method according to claim 26, wherein the reheated product is hot rolled and then the hot rolled product is cold rolled 10 to 20% to the final gauge and the quenched alloy product is stretched 1.5 to 2.0% after quenching, wherein the amount of Cu is in a range of 1.7 to 2.2 wt. %, the amount of Mg is in a range of 1.7 to 2.2 wt. %, the amount of Zn is in a range of 8.0 to 8.7 wt. %.

29. Method according to claim 1, wherein the amount of Cu is in a range of 1.7 to 2.2 wt. %, wherein the amount of Mg is in a range of 1.7 to 2.2 wt. %, wherein the amount of Zn is in a range of 8.0 to 8.7 wt. %.

30. Method according to claim 1, wherein the ingot consists of the following composition, in weight percent:

Zn 6.0 to 11.0%
Cu 1.4 to 2.2%
Mg 1.4 to 2.4%
Zr 0.05 to 0.15%
Ti <0.05%
Hf and/or V <0.25%
optionally Sc and/or Ce 0.05 to 0.25%,
optionally Mn 0.05 to 0.12%, and
inevitable impurities and balance aluminium.

31. Method according to claim 30, wherein the method performed from step (b) through (e) consists of steps (b), (c), (d) and (e), wherein the reheated product is hot rolled and then the hot rolled product is cold rolled 10 to 20% to the final gauge and the quenched alloy product is stretched 1.5 to 2.0% after quenching, wherein the final gauge is in the range of 4 to 50 mm, wherein the amount of Cu is in a range of 1.7 to 2.2 wt. %, the amount of Mg is in a range of 1.7 to 2.2 wt. %, the amount of Zn is in a range of 8.0 to 8.7 wt. %, wherein the artificial ageing during step g) consists of a first ageing step at a temperature around 155° C. to 160° C. for 4 to 12 hours to a temper selected from T79 and T76 temper.

32. Method according to claim 31, wherein the ingot includes, in weight percent, 0.06 to 0.25% Sc.

* * * * *